US005636698A

United States Patent [19]

Estep et al.

[11] Patent Number: 5,636,698

[45] Date of Patent: Jun. 10, 1997

[54] TUBE NUT WRENCH

[75] Inventors: John M. Estep, Granville Summit; Harry E. Morris, III, Milan; Donald R. Warner, Columbia Cross Roads, all of Pa.

[73] Assignee: Ingersoll-Rand Company, Woodcliff Lake, N.J.

[21] Appl. No.: 715,799

[22] Filed: Sep. 19, 1996

Related U.S. Application Data

[63] Continuation-in-part of Ser. No. 328,181, Oct. 24, 1994.

[51] Int. Cl.[6] ..... B25B 21/00

[52] U.S. Cl. ..... 173/2; 173/176; 173/216; 173/217; 81/57.13

[58] Field of Search ..... 173/1, 2, 19, 176, 173/181, 183, 213, 216, 217; 81/57.13

[56] References Cited

U.S. PATENT DOCUMENTS

| | | | |
|---|---|---|---|
| 3,987,692 | 10/1976 | Lesner et al. | 81/57.13 |
| 4,064,772 | 12/1977 | Boyd et al. | 81/57.13 |
| 4,493,377 | 1/1985 | Günther et al. | 173/170 |
| 4,858,312 | 8/1989 | Van Naarden | 173/1 X |
| 5,062,491 | 11/1991 | Takeshima et al. | 173/181 |
| 5,105,519 | 4/1992 | Doniwa | 173/1 X |
| 5,154,242 | 10/1992 | Soshin et al. | 173/178 |
| 5,285,857 | 2/1994 | Shimada | 173/111 |
| 5,440,215 | 8/1995 | Gilmore | 173/178 X |

*Primary Examiner*—Joseph J. Hail, III
*Assistant Examiner*—Jay A. Stelacone
*Attorney, Agent, or Firm*—Walter C. Vliet

[57] ABSTRACT

A separate thumb accessible pushbutton operated circuit revises the power operated tube nut wrench at a reduced speed to intercept a home stop wherein after the wrench is automatically shut off on the sensing of current rise in the motor on stall to avoid over stress and unnecessary heat buildup.

4 Claims, 2 Drawing Sheets

TUBE NUT WRENCH

This application is a continuation-in-part of application Ser. No. 08/328,181, filed Oct. 24, 1994.

BACKGROUND OF THE INVENTION

This invention relates generally to power driven nutrunners and more particularly to direct current tube nut wrenches which require the operator to switch the tool in reverse returning the drive to its home position and then switch it back to forward for the next tube nut. Some of the present wrenches return the drive at full power which causes excessive stress and wear in the return mechanism. In addition, if the wrench continues to be activated upon return to the home position, excessive heat build up can be generated in the stalled motor device.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a tube nut wrench including a power driven wrench providing rotational output on a tube nut drive head of the type which receives a tube within its confines in one rotary orientation and captures a nut on the tube in a second rotary operating position during a tightening process of the nut, the improvement comprising a reverse drive initiating means for initiating reverse rotation of the nut drive head to a first tube receiving position limited by a stop; and a means for sensing arrival at the stop and shutting the reverse drive off.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
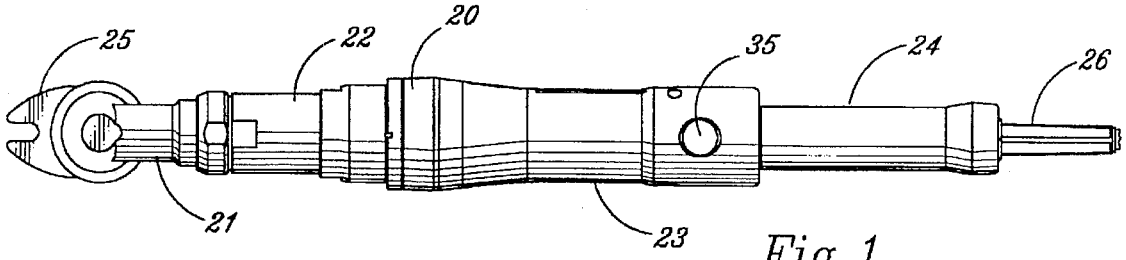
FIG. 1 is a plan view of a DC electric assembly tool of the tube nut wrench variety according to the present invention.
Figure 2:
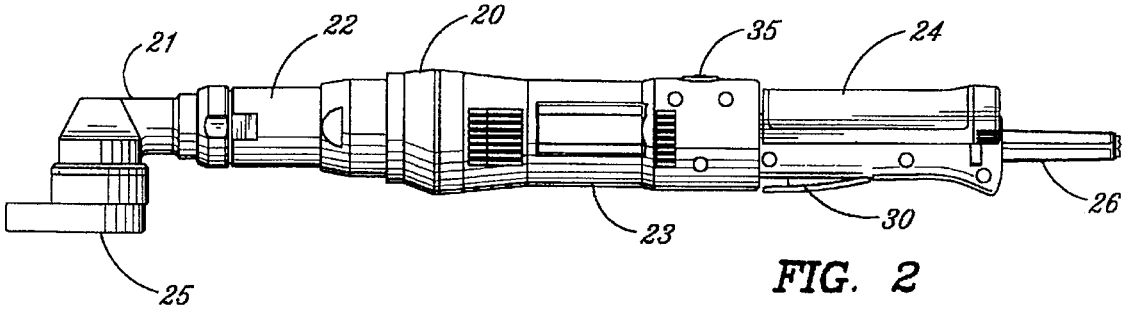
FIG. 2 is a side elevation view of the DC tube nut wrench according to the present invention.

FIGS. 1 and 2 show a top and side view of a DC tube nut wrench respectively according to the present invention. The DC angle wrench is generally shown and indicated by the reference numeral 20. The wrench is fitted with a tube nut head 25 attached to an angle head drive 21 which in turn is attached to a gear reduction housing 22, a motor housing 23, and a handle 24. The angle wrench is further provided with a control and power cable 26 attached to the end of the handle.

The angle wrench is further provided with a forward throttle handle 30 (seen in FIG. 2) and a reverse actuating switch 35. The forward throttle is conveniently located to be activated by the users' fingers and, according to the present invention, the reverse actuating switch 35 is placed so that it may be conveniently operated by the users' thumb.

In operation, a DC motor enclosed within the motor housing 23, drives through reduction gears, angle head and tube nut head to tighten a tube nut. Once the tube nut reaches the desired torque a transducer sends a signal through the control cable and the DC motor is shut off. The operator then slides the tube nut head off the tube nut up on to the tubing. Unless the tube nut happens to stop in the home position, the operator must then depress the reverse actuating switch 35 which reverse drives the head back to the home position. When the head reaches the home position the ratchet mechanism latches and the reverse torque begins to rise.

Figure 3:
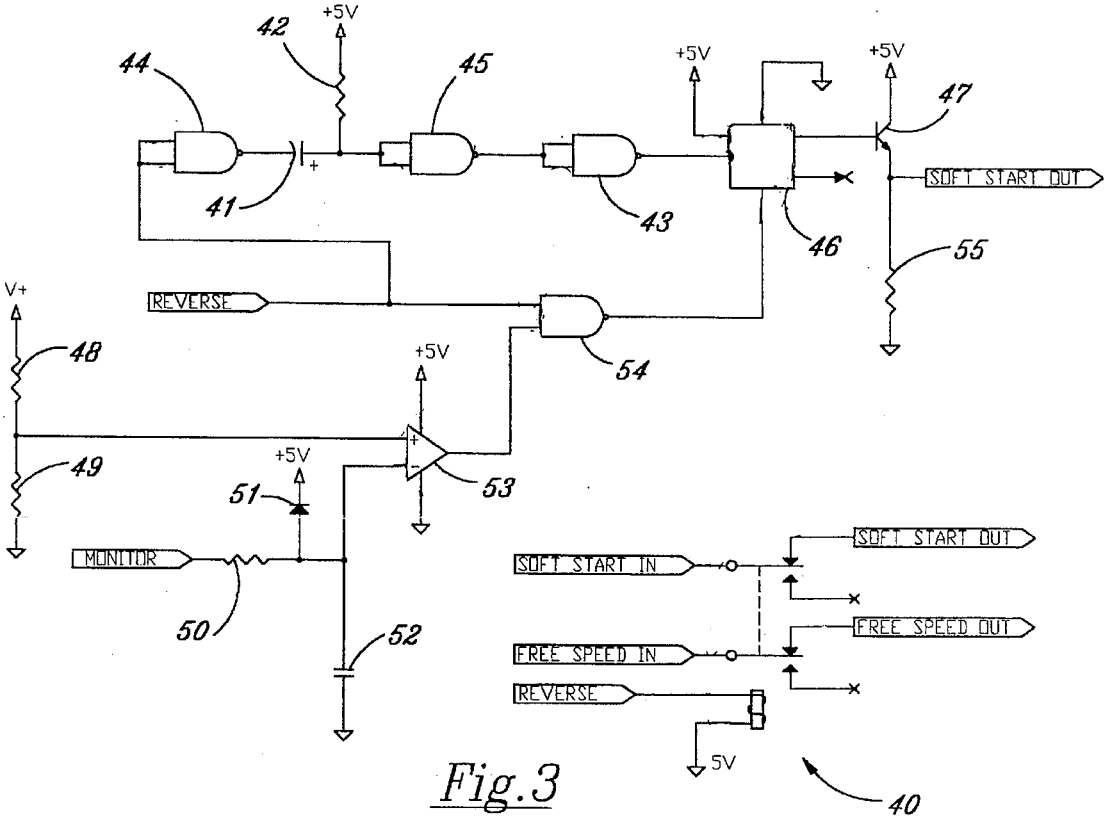
FIG. 3 is a control schematic for the tube nut wrench according to the present invention.

As the torque rises, a specialized circuit as shown in FIG. 3 senses a rise in the current of the motor and shuts the tool off by disengaging the throttle. The operator can then remove the tube nut head off the tubing. The circuit, shown in FIG. 3, performs the task of reversing the tool until the home or index position is reached. It also locks out the tool throttle during this operation and provides a slight delay before reversing the tool until a system calibration check can be completed on the transducer and associated signal conditioning circuitry as is done immediately following any rundown.

The circuit insures that the tool is reversed slowly and shut down immediately once the home position is reached, or if the operator chooses to release the reverse button at any time, the reverse operation may be discontinued. Motor current is used to sense the torque increase in the reverse position. This occurs when the tool reaches the home position. Motor current is used because the normal forward reading torque transducer is calibrated in the forward direction only. The reversing torque is not required to be high unless specifically called for in untightening the nut. A lower home drive torque and the slower speed of operation were thus major considerations of the circuit design.

The homing design circuit, shown in FIG. 3, consists of the following components and operation:

Relay 40 serves to lock out the throttle immediately whenever the reverse button is engaged. A specific time lag is created by the values of capacitor 41 and resistor 42 through signal buffers 43, 44, and 45, before slow reverse action is initiated and held by latch 46, by turning transistor 47 on. Resistors 48 and 49, which may also be replaced by a potentiometer to allow adjustment, set the current level trip point at which the motor will be shut down. A voltage signal representative of the motor current is brought through limiting components 50 and 51 and filtered by a capacitor 52.

Comparator 53 compares the present motor current to the trip level setpoint and resets latch 46 when the proper current is obtained. Note that this reset only occurs if the tool is indeed in reverse due to the logic of buffer 54. When the latch is reset transistor 47 is turned off, the motor enable signal is disabled to ground via resistor 55 and the motor is stopped. Connectors (not shown) bring the necessary signals for the tool throttle motor current and reverse to and from the specialized circuit.

Figure 4:
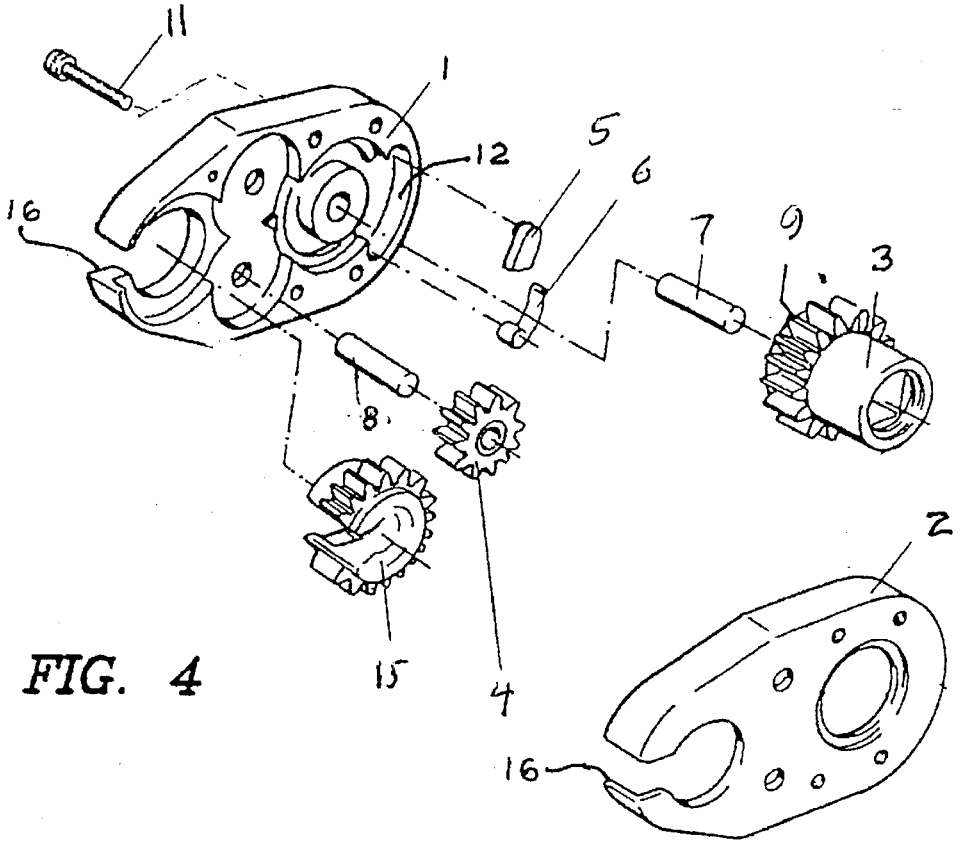
FIG. 4 is an exploded view of the nut drive head according to the present invention.
Figure 5:
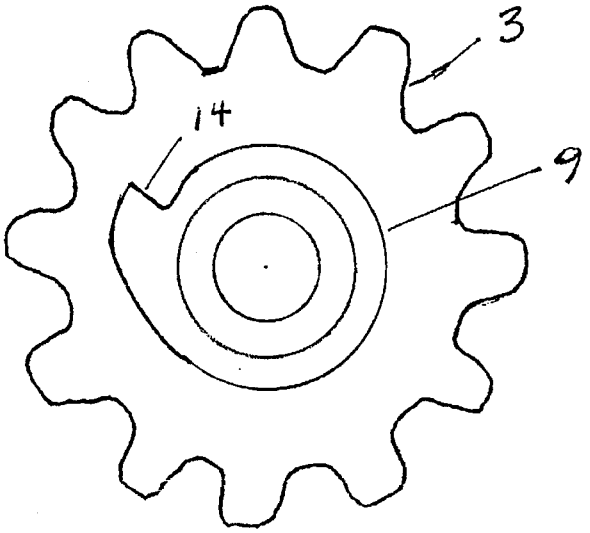
FIG. 5 is an end view of the input spindle gear of the nut drive head showing the reverse stop cam.

FIG. 4 shows an exploded view of a gear offset head according to the present invention comprising a housing bottom part 1 which constitutes the frame for the gear offset head, a housing top part 2 or cap which encloses the bottom part and retains the working parts of the head which includes a rotary input spindle gear 3 having a reverse stop cam 9 on its far side, as partially shown in FIG. 4, and best seen in end view in FIG. 5. The input spindle gear rotates on a shaft 7 and in turn drives the intermediate gear 4 which is part of a pair of gears of which only one is shown.

The intermediate gear 4 rotates on shaft 8 and in turn drives the output gear 15 which contains the nut jaw for the tube wrench. The assembly is held together and mounted to the angle head drive 21 by means of a series of four adapter cap screws 11. A cavity 12 adjacent the input spindle gear contains a reverse stop pawl 5 which is spring loaded to contact the reverse stop cam 9 by means of a spring 6.

As can be appreciated by one skilled in the art the reverse pawl simply rides up over the reverse stop cam in the forward direction to permit rotation. In the reverse direction (clockwise as viewed in FIG. 5), the stop pawl intercepts the stop pawl abutment 14 to prevent reverse rotation at the predetermined point which aligns the output gear Jaw with the opening 16 provided in the geared head housing. The stop, as previously described, is provided as an alignment means permitting insertion and withdrawal of the tube nut wrench about the tube.

Having described our invention in terms of a preferred embodiment, we do not wish to be limited in the scope of our invention except as claimed.

What is claimed is:

1. A tube wrench comprising:

power driven wrench providing rotational output on a tube nut drive head of the type which receives a tube within its confines in one rotary orientation and captures a nut on said tube in a second rotary operating position during a tightening process of said nut, the improvement comprising:

a reverse drive including a reverse drive initiating means for initiating reverse rotation of said nut drive head to a first tube receiving position limited by a stop;

a means for sensing arrival at said stop and shutting said reverse drive off; and said means for sensing arrival at said stop and shutting said reverse drive off comprises a circuit for sensing current rise in said power driven wrench at said stop.

2. A tube wrench according to claim 1 wherein:

said reverse drive initiating means for initiating reverse rotation of said nut drive head further comprises a reverse switch independent of a forward drive select throttle switch.

3. A tube wrench according to claim 1 wherein:

said stop comprises a mechanical stop engageable in a reverse direction at said first tube receiving position.

4. A tube wrench according to claim 1 wherein:

said means for sensing arrival at said stop and shutting said reverse drive off comprises a circuit independent of a circuit for control of said power driven wrench in a tube nut tightening function.

* * * * *